US006540378B2

(12) United States Patent
Alsup

(10) Patent No.: US 6,540,378 B2
(45) Date of Patent: Apr. 1, 2003

(54) MECHANIC'S CREEPER WITH WORK LIGHTING

(76) Inventor: Andrew Jackson Alsup, 122 Stover La., Mooresville, NC (US) 28117

( * ) Notice: Subject to any disclaimer, the term of this patent is extended or adjusted under 35 U.S.C. 154(b) by 0 days.

(21) Appl. No.: 09/781,024

(22) Filed: Feb. 9, 2001

(65) Prior Publication Data

US 2002/0109991 A1 Aug. 15, 2002

(51) Int. Cl.[7] ..... F21V 33/00
(52) U.S. Cl. ..... 362/253; 362/234; 280/32.6
(58) Field of Search ..... 362/253, 486, 362/249, 234; 280/32.6

(56) References Cited

U.S. PATENT DOCUMENTS 4,213,079 A * 7/1980 Mullersman ..... 320/111
4,282,562 A * 8/1981 Marino ..... 362/183
4,986,558 A * 1/1991 Morris ..... 280/32.6
5,382,167 A * 1/1995 Janson, Jr. ..... 439/38

* cited by examiner

*Primary Examiner*—Sandra O'Shea
*Assistant Examiner*—Hargobind S. Sawhney
(74) *Attorney, Agent, or Firm*—Dougherty & Clements LLP

(57) ABSTRACT

The invention consists of an improved automobile mechanic's creeper having built-in rechargeable lamps that are positioned with respect to the mechanic's body such that the undercarriage of the automobile being serviced is effectively illuminated without need for a separate illuminator thereby eliminating the problems concomitant with a separate illuminator.

17 Claims, 6 Drawing Sheets

*Fig.1* *(Prior Art)*
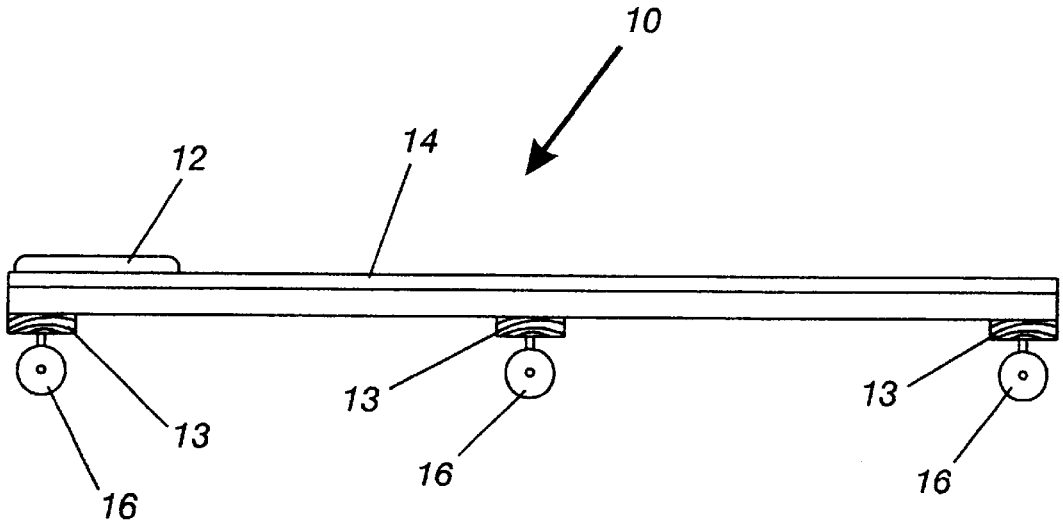
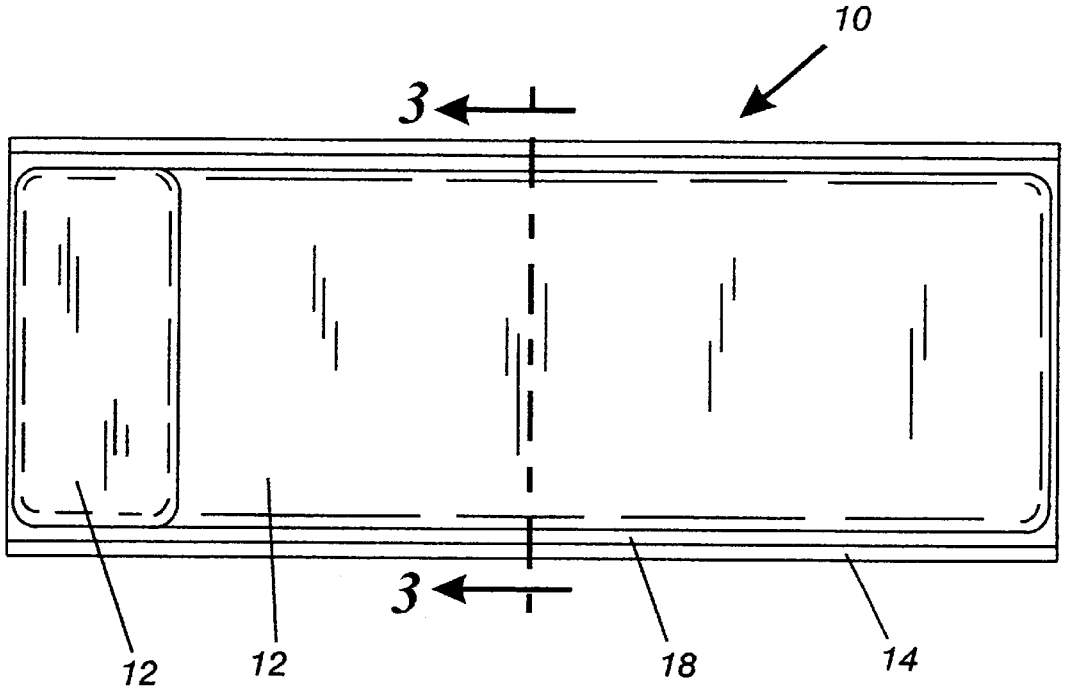
*Fig.2* *(Prior Art)*

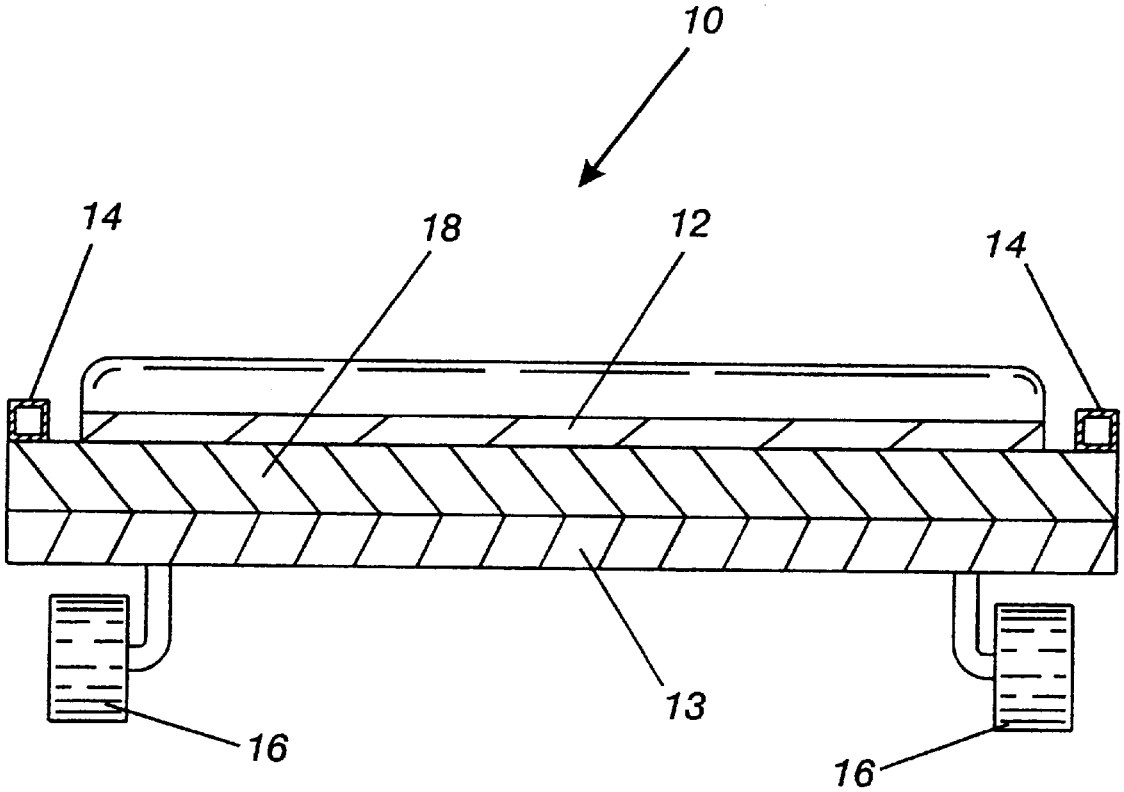
*Fig.3* *(Prior Art)*

MECHANIC'S CREEPER WITH WORK LIGHTING

FIELD OF THE INVENTION

The present invention relates to an apparatus for illuminating work objects. More particularly, it relates to an apparatus for illuminating work objects on the underside of an automobile when work is performed on a low profile, wheeled platform used by automobile mechanics to position themselves at an appropriate work site under an automobile for effecting adjustments or repairs to said automobile.

BACKGROUND OF THE INVENTION

Automobile mechanics often use a low profile, wheeled platform, known as a "creeper" to position themselves under an automobile in order to perform work on or make repairs to the automobile.

When using a creeper, the mechanic is generally supine, with the creeper supporting the mechanic's back. The device is positioned by manipulating the feet whereby the mechanic's weight is supported by the device and little effort is needed to adjust the mechanic's position with respect to the automobile undercarriage.

A mechanic effecting repairs or adjustments under an automobile, using a creeper is faced with the problem of adequately seeing his work. Illumination is generally provided by work lights which may be dry cell battery powered lanterns or incandescent "work lights" which feature an impact-resistant light bulb in a metal cage to minimize inadvertent damage to the bulb. Incandescent work lights generally are provided with a 20 -foot power cord. Flourescent lamps are sometimes provided either with a dry cell battery, a rechargeable battery or a power cord. The mechanic, working in cramped tight quarters must manipulate required tools, required parts and additionally one of the cited illuminators. All these choices have disadvantages. Because it is inexpensive, a common choice is the incandescent work light. This device is also one of the most problematic. The cage that protects the bulb can be difficult to maneuver. In addition, the cage and bulb become hot enough to burn the mechanic's skin if contact is made and sometimes hot enough to exceed the kindling point of materials being handled. In all cases, the mechanic is forced to handle tools, materials needed to perform the task and manipulate the lamp. Aiming the lamp at the work is lamp dependent but is often clumsy and artistic resulting in frustration and lost productivity. Corded devices have the additional problems of cord tangling and constrained distance to an outlet. The mechanic using corded illuminators must often cope with hoses for pneumatic tools, gas hoses for welding and/or power cords for electrically powered tools.

SUMMARY OF THE INVENTION

The invention consists of an improved automobile mechanic's creeper having built-in rechargeable lamps positioned with respect to the mechanic's body such that the problems with discrete lamps are substantially eliminated.

OBJECTS OF THE INVENTION

The object of the invention is to provide an improved creeper having an illumination device that requires no separate handling thus permitting a mechanic to more productively perform a task.

Another object of the invention is to provide an improved creeper having an illumination device for an automobile mechanic that eliminates lost productivity due to power cord manipulation.

BRIEF DESCRIPTION OF THE DRAWINGS

The foregoing and other objects will become more readily apparent by referring to the following detailed description and the appended drawing in which:

FIG. 1 shows a side view of a typical creeper according to prior art;

FIG. 2 shows a top view of the creeper of FIG. 1;

FIG. 3 shows a cross-section of the creeper of FIG. 1;

DETAILED DESCRIPTION

Figure 4:
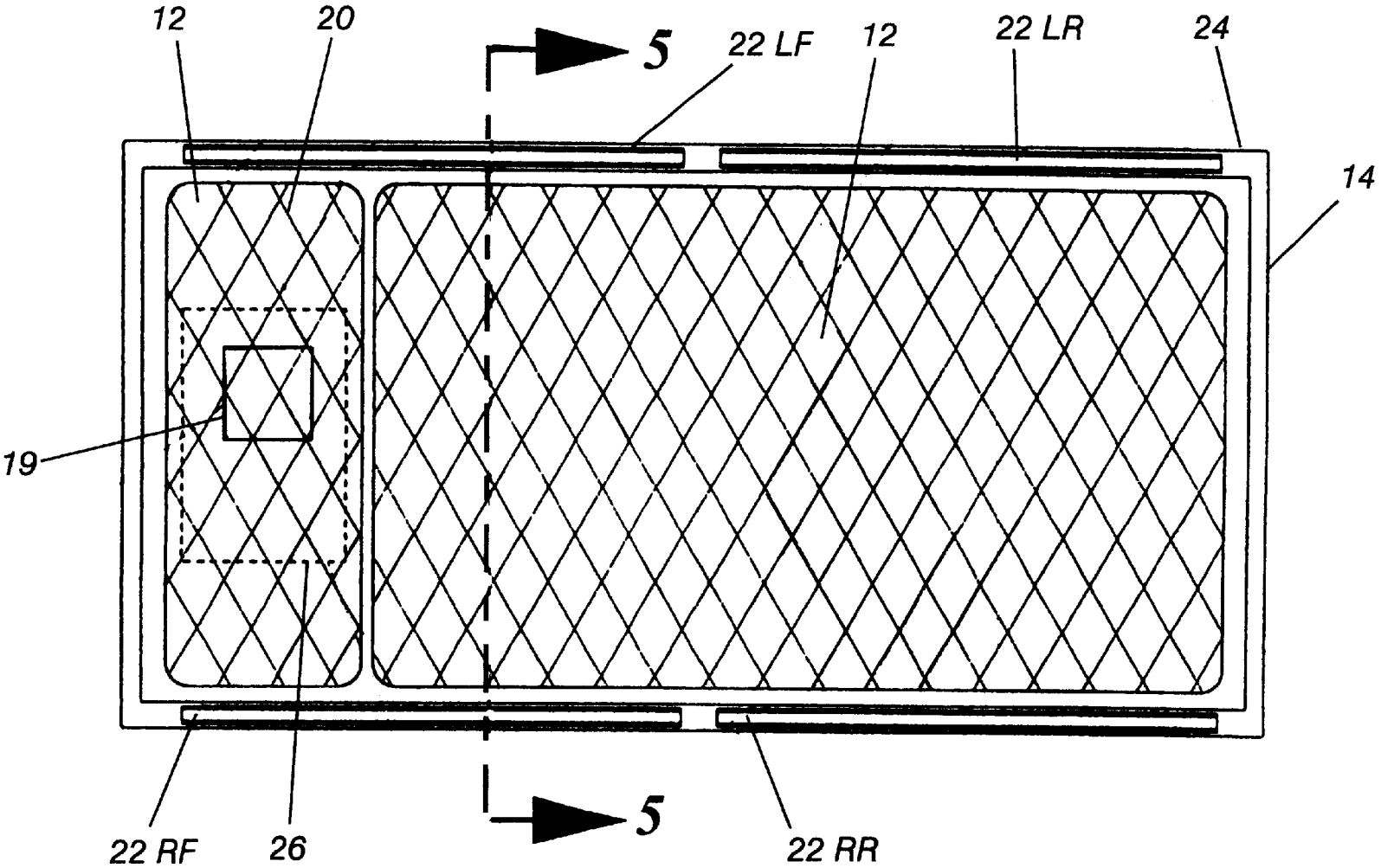
FIG. 4 shows a top view of the improved creeper according to this invention.

The present invention now will be described more fully hereinafter with reference to the accompanying drawings, in which a preferred embodiment of the invention is shown. This invention may, however, be embodied in many different forms and should not be construed as limited to the embodiment set forth herein; rather, this embodiment is provided so that this disclosure will be, thorough and complete, and will convey the scope of the invention fully to those skilled in the art. Like numbers refer to like elements throughout.

Referring to FIGS. 1 and 2, a typical mechanic's creeper 10 consists of a frame, preferably steel, having two longitudinal members 14 connected by three cross-members 13, with the cross-members members 13 provided with a total of Six casters 16. The frame supports a platform 18 that is typically plywood that has been finish-sanded and varnished. The platform 18 typically rests upon and is connected to the cross-members 13. Advantageously, a leatherette-covered foam-rubber pad 12 may be affixed to the platform 18. The foam pad 12 may have a thickened section that acts as a head rest.

Referring to FIG. 3, the platform 18 is supported on three cross members 13 that also mount the casters 16. Longitudinal steel members 14 are bolted or otherwise attached to the cross members 13, through the platform 18. Padding 12, if any, is bonded to the platform 18.

Referring to FIG. 4, the invented creeper differs from prior art creepers in the addition of task lighting. The task lighting is preferably provided by modifying the prior-art longitudinal frame members 14 to accept lighting elements 22 LF, 22 LR, 22 RF and 22 RR for the left-front, left-rear, right-front and right-rear lighting elements, respectively. The invented creeper also includes electrical components for powering the lighting elements 22 within a subassembly 26, including a rechargeable battery 19, a D.C. to A.C. converter, and a transformer electrically connected to the lighting elements 22. The lighting elements are preferably flourescent lamps, but other lamp technology may be used. Flourescent technology is preferred because this technology is currently the most efficient (up to 80-lumens/watt) and because the flourescent bulbs do not reach the high temperatures of incandescent bulbs.

Energy efficiency is desirable to increase battery life. A small temperature increase is desirable for mechanic comfort and workplace safety. Preferably, four lamp assemblies 24 are used, though the invention is operative with as few as one assembly. The lamp assemblies 24 are preferably placed within or on the top of longitudinal members 14, although, the lamp assemblies 24 may be placed at various locations about the creeper, and may even be placed under the creeper, facing downward such that light from the assemblies provides indirect lighting of the automobile undercarriage.

As mentioned above, power for the light assemblies 24 is provided by subassembly 26 that contains a rechargeable battery, a D. C. to A. C. converter and a transformer or equivalent for matching the voltage and current requirement of the lamp or lamps. Subassembly 26 is preferably located on the underside of the creeper, and is more preferably located within the headrest portion of the padding 12.

For purposes of recharging the battery 19 within subassembly 26, the battery 19 is operationally connected to a recharger 30 by a recharging circuit 31, as shown in FIG. 7and further described below. The recharger 30 can be. a component separate from the creeper or may be integrated into the subassembly 26. For example, when configured as a separate component, the recharger 30 can be plugged into a wall socket 33. By attaching the recharger 30 to the wall socket 33, and respectively attaching the creeper 10 to the recharger 30, the creeper 10 is conveniently stowed on a wall 32 during recharging. The recharger 30 is provided with a lip 37 which supports the creeper 10 in hanging position on the wall 32. Various mating means can be used to electrically attach the recharging circuit 31 to the recharger 30. One mating means includes two metal contacts 34 which may be plated with a corrosion-resistant metal (such as beryllium-copper or gold). Alternately, a magnetic coupler 35, as shown in FIG. 8, may be used so that the power attachment consists of a magnetic core 36 that is packaged in a sturdy plastic. Preferably, the subassembly 26 has a male part that mates with a female part that is connected to house A. C. power, and oscillating magnetic fields from a primary coil in the female part couple energy from house power to a recharging battery pack in battery subassembly 26. Alternatively, any common electrical coupling means may be used to connect the battery containing subassembly 26 to the recharging unit.

The lamps are switched on and off by a switch or switches 40 packaged to be reached easily by the mechanic along the rear portion (near the headrest) of the creeper. Preferably, two switches are included so the operation is convenient for right handed and for left-handed mechanics. In this case, two single pole double throw switches 40 are used and wired so that either switch reverses the state of the lamp(s) when toggled. The switches 40 are electrically connected between the battery containing subassembly 26 and the light assemblies 24.

Figures 5, 6:
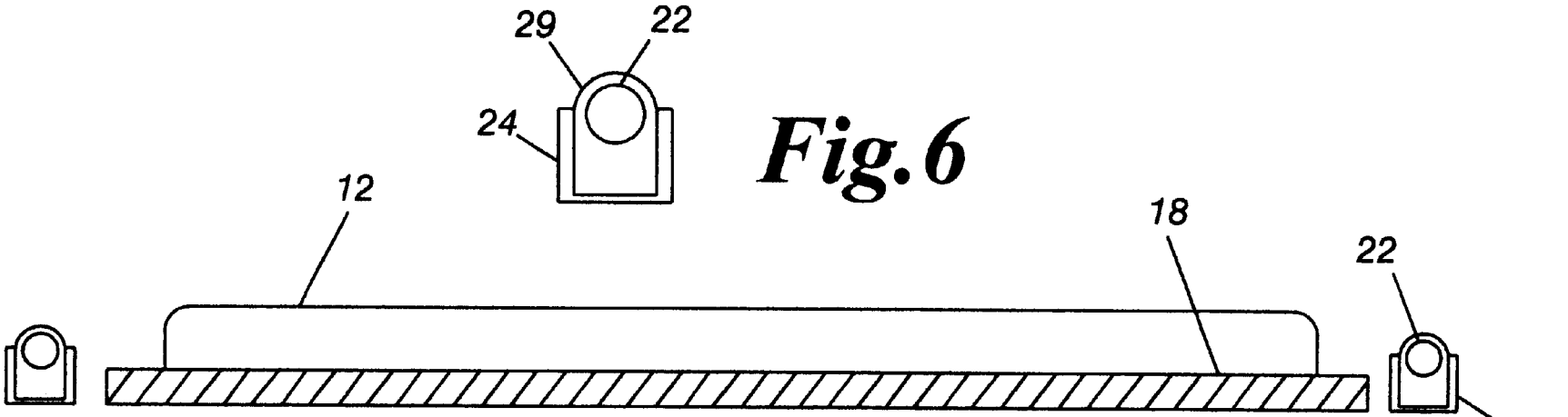
FIG. 5 shows a cross-section of the improved creeper of FIG. 4.
FIG. 6 shows a cross-section of the illuminator of the improved creeper.

Referring to FIGS. 5 and 6, longitudinal frame member 24 is preferably modified to accept a lamp 22 and protective cover 26. The protective cover 29 may be fashioned of polymethyl methacrylate (Lucite ©) or any equivalent clear, rugged plastic or reinforced glass.

Figure 7:
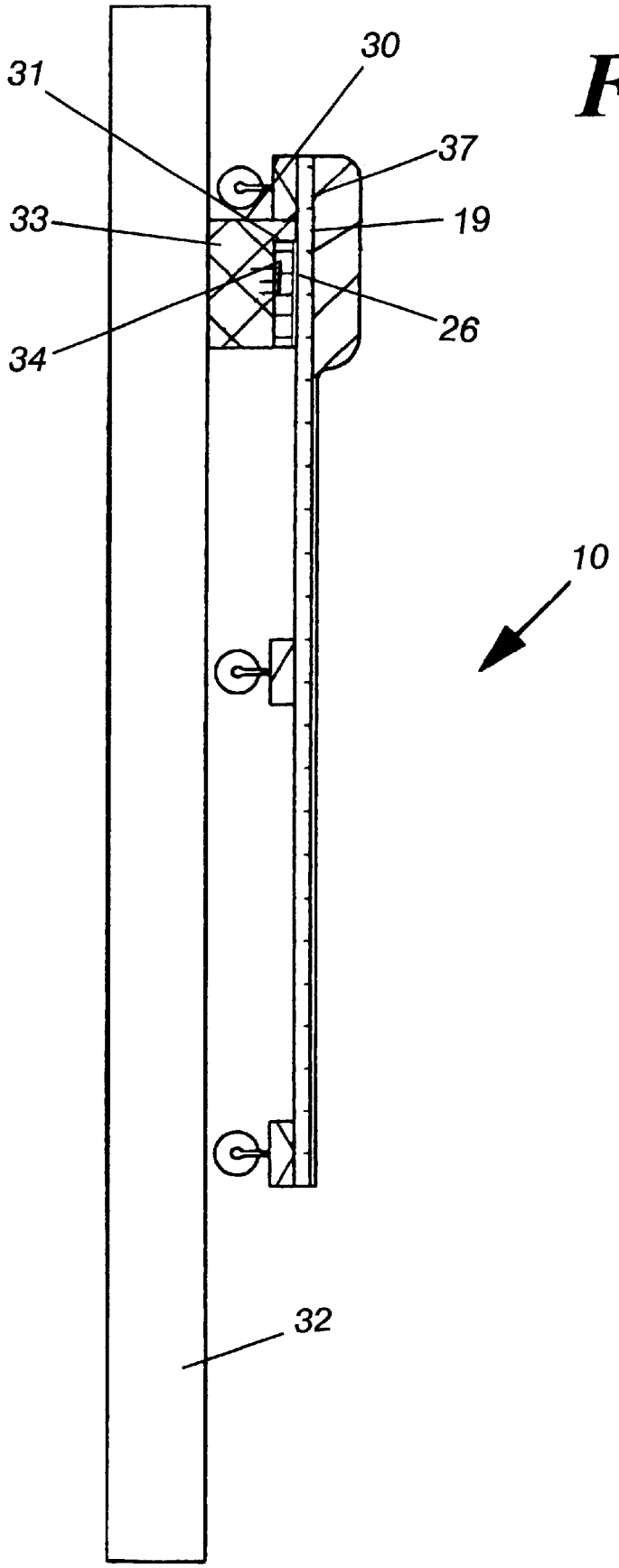
FIG. 7 shows a cross-section of the improved creeper in its recharging mount.
Figure 8:
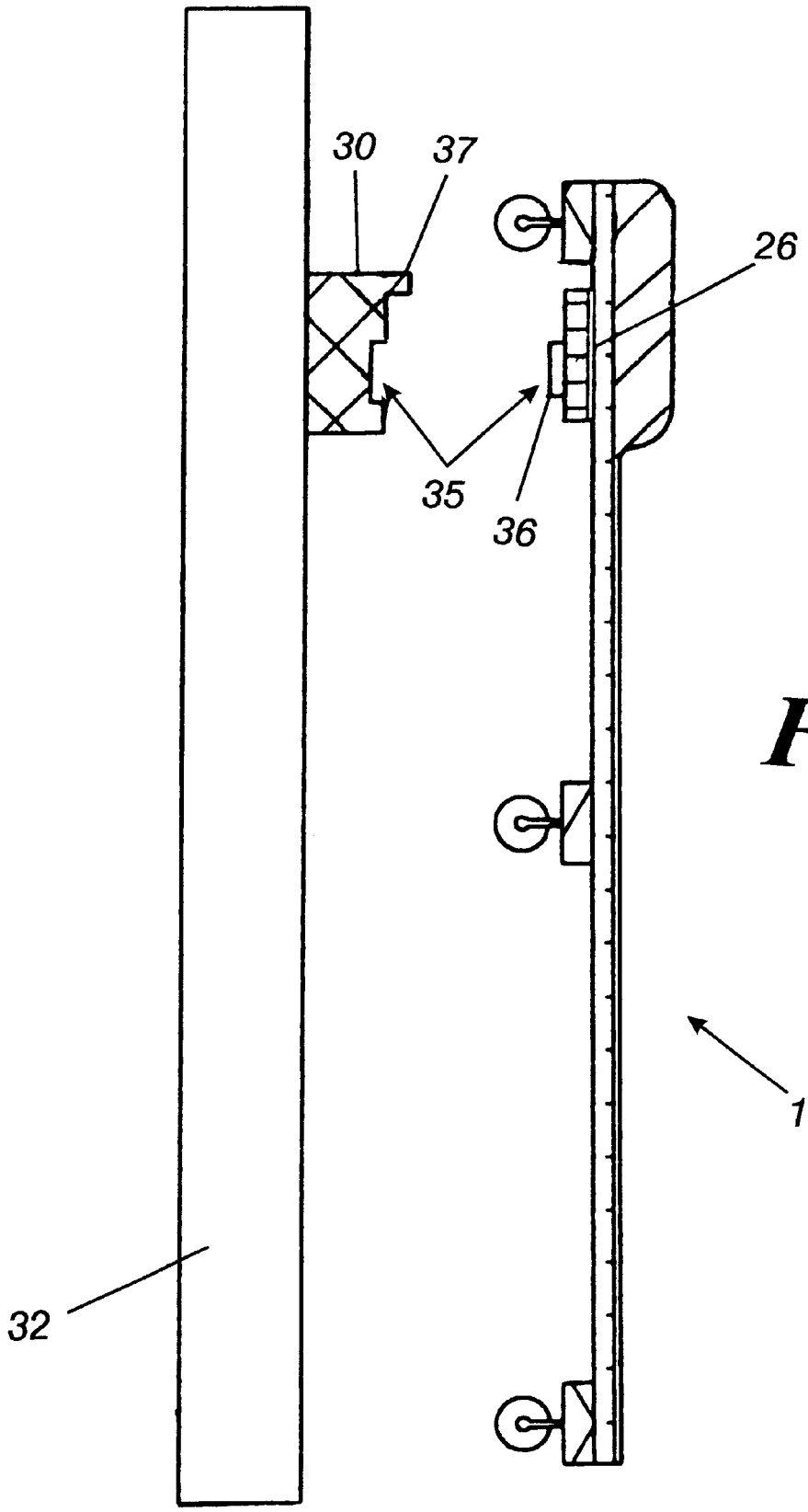
FIG. 8 shows a side view of the improved creeper but with a magnetic coupler for attachment to a recharger.

Referring to FIG. 7, a preferred method of recharging the invented creeper is by mounting the creeper on the wall 32 for recharging. A voltage converter is attached to household power and may contain a recharging unit 30 (in the alternative of metal recharging contacts) or simply house a primary transformer coil packaged around a female socket. In the later case, the recharger is contained in the battery subassembly 26. When the creeper is no longer in use by a mechanic, the creeper is simply mounted on the mating fixture for recharging.

SUMMARY OF THE ACHIEVEMENT OF THE OBJECTS OF THE INVENTION

From the foregoing, it is readily apparent that I have invented an improved creeper having an illumination device that requires no separate handling thus permitting a mechanic to more productively perform a task and that additionally eliminates lost productivity caused by to power cord manipulation.

It is to be understood that the foregoing description and specific embodiments are merely illustrative of the best mode of the invention and the principles thereof, and that various modifications and additions may be made to the apparatus by those skilled in the art, without departing from the spirit and scope of this invention.

What is claimed is:

1. An improved automobile mechanic's creeper comprising;

a creeper having:

a platform;

at least two parallel, elongate, longitudinal frame members attached to, and extending about the full length of, said platform, wherein each of said frame members has at least one longitudinal wall;

at least one lamp juxtaposed with said wall, said at least one lamp extends about the full length of said platform; and a power source attached to said creeper and operatively connected to said at least one lamp for providing electrical power to said lamp.

2. The apparatus recited in claim 1 wherein said at least one lamp is a fluorescent lamp.

3. The apparatus recited in claim 1 wherein said power source comprises a rechargeable battery and a D. C. to A. C. converter to provide power consistent with said lamp.

4. The apparatus as recited in claim 3 wherein said power source additionally comprises a recharging circuit operatively connected to said rechargeable battery.

5. The apparatus as recited in claim 4 additionally comprising a mating means for attaching said recharging circuit to a wall-mounted recharging unit.

6. The apparatus as recited in claim 5 wherein said mating means is magnetic.

7. The apparatus as recited in claim 5 wherein said mating means includes metallic contacts.

8. The apparatus as recited in claim 4 wherein said recharging unit is attached to said creeper.

9. The apparatus recited in claim 4 wherein said recharging unit is adapted for mounting to a wall socket.

10. The apparatus recited in claim 9 wherein said creeper includes a lip for cooperating with said recharger unit to support said creeper, adjacent a wall, on said recharger unit.

11. The apparatus recited in claim 1 wherein said longitudinal frame members are parallel and include an elongate longitudinal channel, and wherein said at least one lamp is disposed within said channel.

12. The apparatus recited in claim 11, wherein said creeper is generally rectangular in shape.

13. The apparatus recited in claim 12 additionally comprising a pad attached to said platform.

14. The apparatus recited in claim 13 further including a cover disposed over said channel and enclosing said at least one lamp therebetween.

15. The apparatus recited in claim 14 wherein said power source is attached to the underside of said platform.

16. The apparatus recited in claim 14 wherein said power source is disposed within said pad.

17. An improved automobile mechanic's creeper comprising:

a creeper having:

a platform;

at least two parallel, elongate, longitudinal frame members attached to, and extending about the full length of, said platform, wherein each of said frame members has at least one longitudinal wall;

at least one lamp attached to the underside of said creeper, wherein said at least one lamp extends about the full length of said platform, for indirectly illuminating an area above the creeper wall; and a power source attached to said creeper and operatively connected to said at least one lamp for providing electrical power to said lamp.

* * * * *